US009314805B2

(12) United States Patent
Ross

(10) Patent No.: US 9,314,805 B2
(45) Date of Patent: Apr. 19, 2016

(54) DEVICE FOR CLEANING CLOSED SPACES

(75) Inventor: Martin Ross, Sjöbo (SE)

(73) Assignee: Scanjet Marine AB (SE)

( * ) Notice: Subject to any disclaimer, the term of this patent is extended or adjusted under 35 U.S.C. 154(b) by 1189 days.

(21) Appl. No.: 13/320,986

(22) PCT Filed: Jun. 4, 2010

(86) PCT No.: PCT/SE2010/050618

§ 371 (c)(1),
(2), (4) Date: Nov. 17, 2011

(87) PCT Pub. No.: WO2010/144035

PCT Pub. Date: Dec. 16, 2010

(65) Prior Publication Data

US 2012/0060872 A1 Mar. 15, 2012

(30) Foreign Application Priority Data

Jun. 8, 2009 (SE) ..... 0950419

(51) Int. Cl.

| | |
|---|---|
| ***B08B 9/093*** | (2006.01) |
| ***B05B 3/04*** | (2006.01) |
| ***B05B 15/02*** | (2006.01) |
| *B05B 13/06* | (2006.01) |

(52) U.S. Cl.

CPC ..... *B05B 3/0445* (2013.01); *B05B 15/0258* (2013.01); *B08B 9/0936* (2013.01); *B05B 13/0636* (2013.01)

(58) Field of Classification Search

CPC ..... B05B 3/0445; B05B 15/0258; B05B 13/0636; B08B 9/0936

See application file for complete search history.

(56) References Cited

U.S. PATENT DOCUMENTS 2,029,788 A * 2/1936 Ostling ..... 239/227
2,895,688 A * 7/1959 Seiberling et al. ..... 239/559

(Continued)

FOREIGN PATENT DOCUMENTS

EP 1 338 341 A1 8/2003
FR 2184240 12/1973

(Continued)

OTHER PUBLICATIONS

Invoice No. 17065 dated Mar. 20, 2006.

(Continued)

*Primary Examiner* — Michael Barr
*Assistant Examiner* — Benjamin L Osterhout
(74) *Attorney, Agent, or Firm* — Tarolli, Sundheim, Covell & Tummino LLP

(57) ABSTRACT

Device that includes a housing with a stationary part configured to receive liquid into the device and a rotatable part arranged with the stationary part. The rotatable part is rotatably arranged with a hub with at least one spray nozzle. In the housing there is an axis with one part connected to a rotation generating element in the housing and another part provided with threads forming a worm screw. The worm screw fits into the threads of an adjacent first gear wheel forming a worm gear. The worm gear transmits rotational force from the rotation generating element via the axis for rotating the hub and the rotatable part. The rotation generating element, the axis and the worm gear are arranged in a flow path for liquid passing through the device, whereby the bulk of the liquid flows through the worm gear in a direction towards at least one spray nozzle.

16 Claims, 3 Drawing Sheets

(56) References Cited

U.S. PATENT DOCUMENTS

| | | | | |
|---|---|---|---|---|
| 2,917,243 | A * | 12/1959 | Lione | 239/227 |
| 3,052,574 | A * | 9/1962 | Kennedy, Jr. | 134/24 |
| 3,275,241 | A | 9/1966 | Saad | |
| 3,544,012 | A * | 12/1970 | McNally | 239/227 |
| 3,556,407 | A | 1/1971 | Niikura et al. | |
| 3,834,625 | A | 9/1974 | Barthod-Malat | |
| 4,244,524 | A * | 1/1981 | Wellings | 239/227 |
| 5,333,630 | A * | 8/1994 | Jepsen et al. | 134/104.1 |
| 6,213,134 | B1 * | 4/2001 | Pike | 134/166 R |
| 7,686,893 | B2 * | 3/2010 | Robinson | 134/168 R |
| 2003/0137895 | A1 | 7/2003 | Hummer | |
| 2003/0145880 | A1 * | 8/2003 | Jepsen et al. | 134/167 R |

FOREIGN PATENT DOCUMENTS

| | | |
|---|---|---|
| GB | 867384 | 5/1961 |
| WO | WO 92/04994 | 4/1992 |

OTHER PUBLICATIONS

Invoice No. 10932 dated May 13, 2005.

Tank Cleaning Machine, Type TZ-65 Fixed, Operators Manual No. 91A200-01, Version 991, published 1999.

User Instruction and Maintenance Manual for Tank Cleaning Machine Type TZ-65, Fixed, Manual No. 91A201, Version 881, published 1988.

Instruction Manual Type Gunclean Toftejorg SSt40T, IM-TE91A560-EN041, published 1996.

Tank Cleaning Machine, Type TJ20G, Operators Manual No. 91A600-01, Version 991, published 1999.

Instruction Manual entitled "Toftejorg SaniMega" IM-TE91A590-EN1, Aug. 2005.

* cited by examiner

DEVICE FOR CLEANING CLOSED SPACES

RELATED APPLICATION

This application corresponds to PCT/SE2010/050618, filed Jun. 4, 2010, which claims the benefit of Swedish Patent Application No. 0950419-2, filed Jun. 8, 2009, the subject matter of which is incorporated herein by reference.

FIELD OF THE INVENTION

The present invention relates to a device for cleaning of closed spaces using a sprayed liquid according to claim 1.

BACKGROUND OF THE INVENTION

The international patent document WO 92/04994 discloses a device for cleaning of closed spaces. In the device according to WO 92/04994 liquid flows through the device towards its nozzle in order to be sprayed out into the space where it is arranged. A planetary gear unit is positioned inside the device. The planetary gear unit transmits rotational motion through a number of gears to the device whereby liquid that is supplied to the device is thereby sprayed in a spray pattern around the space. The liquid entering the device can sometimes contain particles that can come from tanks or pipelines. When the particles enter the planetary gear unit with its incorporated gear wheels this may result in them becoming wedged between two adjacent gears. This then results in the gear wheels locking together. Such locking prevents the device from executing the spray pattern and spraying liquid into the space. To address this, the device must be disassembled whereby the prohibitive particles between two gears can thereby be removed. This is a procedure that is time consuming and makes the job of cleaning of a closed space more costly.

SUMMARY OF THE INVENTION

An aim of the present invention is to obtain improved reliability of the device when liquid containing particles flows through the device.

A further aim of the invention is to obtain a high gearing of the gears inside the device. This while the device is compact and not bulky.

A further aim of the invention is to overcome the above-mentioned problems with the prior art.

A further aim of the invention is to provide a device and a method that are cost effective to apply compared to conventional technology, and whereby the device is simple to construct and manufacturing costs and time can be optimized.

The above-mentioned aims and other aims are achieved according to the invention by the device described by way of introduction being given the features recited in claim 1.

The advantage achieved with a device according to claim 1 is that the operational safety of the device is higher compared to other devices within the field when using liquid containing particles through the device.

Preferred embodiments of the device according to the invention have further been given the features recited in the dependent claims 2-16.

According to one embodiment of the invention the first gear wheel is arranged on a second axis. The first gear wheel is fixedly connected to the second axis. The first gear wheel rotates in a plane parallel to the axis on which the worm screw is arranged. One effect of this is that the first axis' rotation can thereby be transferred to the second axis.

According to a further embodiment of the invention, the second axis is provided with a threaded part that forms a second worm screw. The second axis is rotatably connected to a fastening element. The fastening element is connected to the rotatable part of the housing. One effect of the second worm screw is that the number of gear wheels in the gear unit can thereby be reduced compared to a gear unit using only gear wheels.

According to a further embodiment of the invention the threads of the second worm screw fit into the threads of a second gear wheel. The second axis is brought to rotate by the first gear wheel that is driven by the first worm screw. One effect of this is that the rotation of the worm screw can thereby be transferred to the second gear wheel.

According to a further embodiment of the invention, the second gear wheel is arranged on a third axis. The second gear wheel is configured to rotate in a plane parallel to the second axis. The second worm screw and the second gear wheel form a second worm gear. One effect of the second gear wheel is that it transmits its rotation to the third axis.

According to a further embodiment of the invention the third axis is provided with a third gear. The second gear wheel is fixedly attached to the third axis. Furthermore, the third gear wheel is fixedly attached to the third axis. The second and the third gear wheels are arranged at a distance from each other on the third axis.

According to a further embodiment of the invention the third axis is parallel to the first axis. The third axis is rotatably connected to the fastening element as described above. According to one embodiment, this fastening element can be an independent fastening element separated from the first fastening element. The fastening element is then attached inside the housing in the same way as the first fastening element. One effect of the first and the third axes being parallel to one another is that the gear unit in the rotatable part will be compact and thereby not bulky.

According to a further embodiment of the invention the second axis is perpendicularly arranged with respect to at least one of the first or a third axis. Due to the second axis' perpendicular position relative to at least one of the first or the third axis a solution that makes the gear unit compact inside the housing is obtained.

According to a further embodiment of the invention a turbine flow passage is arranged between the stationary part and the rotatable part. The turbine flow passage extends from the stationary part to the rotatable part. The axis with the rotation generating element and the worm screw is arranged centrally through the turbine flow passage. An effect of the turbine flow passage is to lead the liquid from the stationary part to the rotatable part. A further effect of the turbine flow passage is to be designed so that a turbine can be arranged inside it.

According to a further embodiment of the invention the turbine flow passage is connected to the stationary part with a locking ring. The locking ring is arranged on the inside of the turbine flow passage. A number of recesses is arranged through the wall section of the turbine flow passage. The recesses may pass through the wall section of the turbine flow passage. In each recess an attachment element is arranged. The attachment element has a length whereby when it is arranged in the recess and through the wall section, part of it protrudes to the outside of the turbine flow passage. On the inside of the turbine flow passage the attachment element is designed with a head that has a diameter larger than the recess. The attachment element can not thereby slide through the recess because its head prevents this. The locking ring presses against each head on the inside of the turbine flow passage. The attachment elements are in this way held in place in each recess. The respective attachment elements that extend to the outside of the turbine flow passage fit into an internal edge section arranged in the stationary part. When fitted against the edge section of the attachment element the turbine flow passage thereby becomes statically connected to the stationary part.

According to a further embodiment of the invention the turbine flow passage is arranged with an outer plate. The outer plate has a side that faces the stationary part.

According to a further embodiment of the invention, the outer plate is configured to bear against a bearing. The stationary part's inner edge section has a bottom side that faces the rotatable part. A space is arranged between the turbine flow passage's outer plate and the bottom side of the stationary part's inner edge section. Due to this, the bearing between the stationary part and the rotatable part can be arranged in a protected manner in the device.

According to a further embodiment of the invention the bearing is arranged next to a bearing ring. The bearing can also be constructed as an integral part of the bearing ring. One effect of the bearing ring is that it interacts with the turbine flow passage's outer plate whereby the intermediate bearing is kept in position therebetween.

According to a further embodiment of the invention the bearing ring is connected to the rotatable part. The connection is such that the bearing ring is mounted in the rotatable part. Threads are arranged on the part of the rotatable part that is adjacent to the stationary part. The threads are on the part that is internally arranged in the rotatable section. The bearing ring is provided with external threads. The bearing ring is configured to be connected with its threads to the threads arranged in the rotatable part on the part that is adjacent to the stationary part. The bearing is, as previously mentioned, arranged between the bearing ring and the outer plate of turbine flow passage. The bearing ring is configured so that when it is mounted in the rotatable part it has a static position with respect to the rotatable part. The rotation between the stationary part and the rotatable part thereby takes place between the bearing ring and the outer plate, between which the above-mentioned bearing is arranged.

The rotatable part is connected to the stationary part since the turbine flow passage's outer plate is located inside the rotatable part inside the bearing ring. Since the bearing ring is connected to the rotatable part, the stationary part of the turbine flow passage becomes connected to the rotatable part.

According to a further embodiment of the invention the rotation generating element is primarily arranged in the stationary part. By arranging the rotation generating element in the stationary part a compact device is obtained since the associated worm gear is thereby arranged in the rotatable part.

According to a further embodiment of the invention the rotation generating element is a turbine. By using a turbine efficient use of the flow through the device for generating rotation of the axis extending through the turbine flow passage is obtained.

BRIEF DESCRIPTION OF THE DRAWINGS

A preferred embodiment of the device according to the invention will now be described in more detail with reference to the attached schematic drawings, which show only the details necessary to understand the invention.

DETAILED DESCRIPTION OF DIFFERENT EMBODIMENTS OF THE INVENTION

Figure 1:
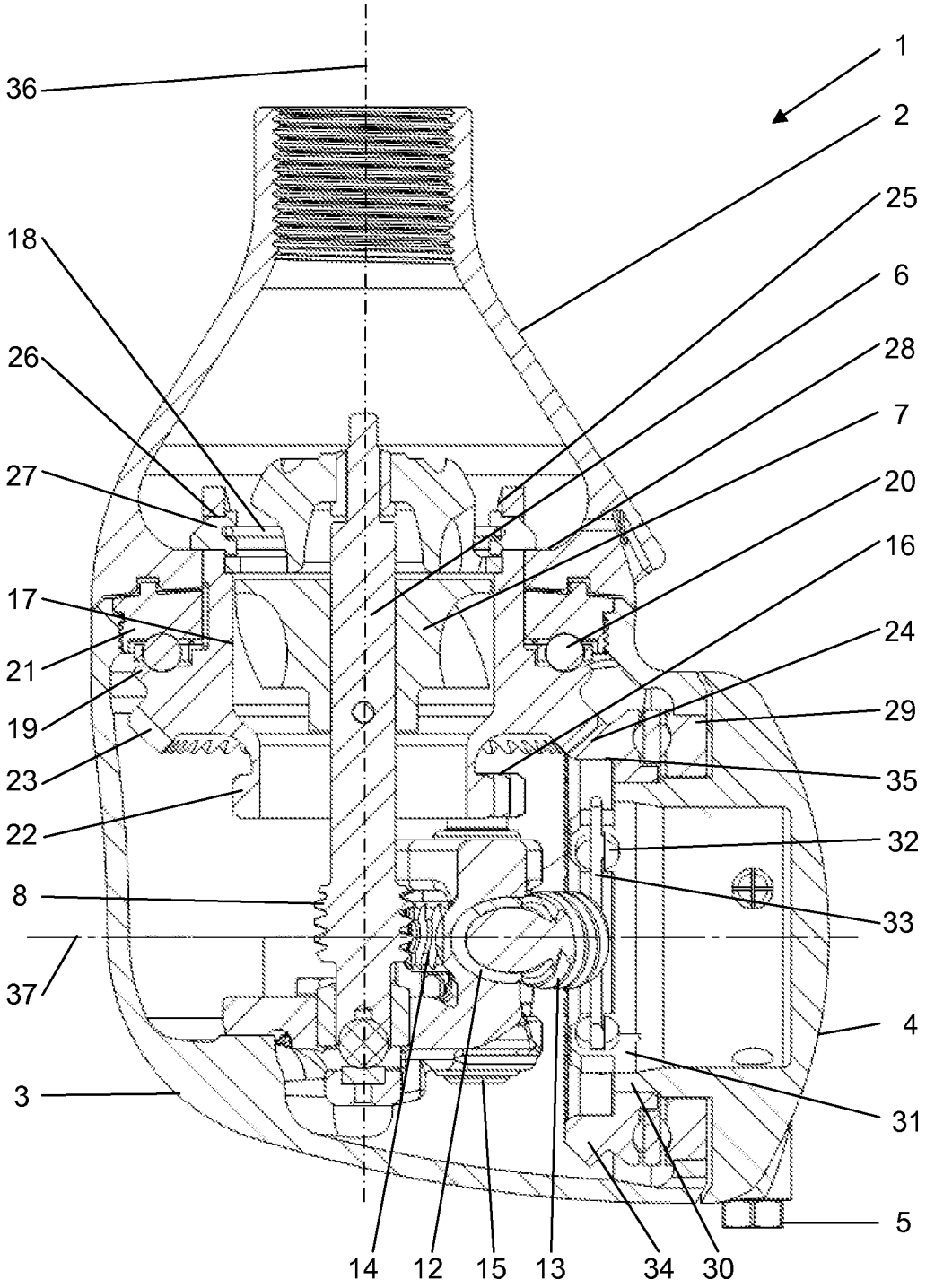
FIG. 1 shows a device according to the invention in cross-section from the side.

FIG. 1 shows a device for cleaning of closed spaces using a sprayed liquid. The device includes a housing 1 with a stationary part 2 and a rotatable part 3. A hub 4 is arranged against the rotatable part. A set of spray nozzles 5 is arranged on the hub 4. An axis 6 is arranged in the housing 1. This axis 6 extends from the inside of the stationary part 2 and into the inside of the rotatable part 3. A rotation generating element 7 is arranged on part of the axis 2. A number of threads forming a worm screw 8 is arranged on a second part of the axis 2. The axis 6 extends centrally through a turbine flow passage 17. The turbine flow passage 17 is configured to lead liquid from the stationary part 2 to the rotatable part 3.

The axis 6 that extends centrally through the turbine flow passage 17 is arranged with the part arranged with the worm screw 8 positioned inside the rotatable part 3. The axis 6 has at this part a lower end that rests on, or that is rotatably connected to, a support element inside the rotatable part 3. The worm screw 8 is configured to interact with a first gear wheel 9 (see FIG. 2). Together, the worm screw 8 and the first gear wheel 9 form a worm gear 10. The first gear wheel 9 is arranged on a part of a second axis 12, which axis 12 is perpendicular to the first axis 6. A second worm screw 13 (see FIG. 1) is arranged on a second part of the second axis 12. The second worm screw 13 is configured to interact with a second gear wheel 14 arranged on a third axis 15. The third axis 15 is arranged parallel to the first axis 6. The second gear wheel 14 rotates in a plane parallel to the extension of the second axis 12. The second gear wheel 14 and the second worm screw 13 on the second axis 12 together form a second worm gear.

The third axis 15 is provided with a third gear wheel 16. This third gear 16 is configured to interact with a first sprocket wheel 22. Said first sprocket wheel 22 is arranged outside the turbine flow passage 17.

The turbine flow passage 17 is provided with a second sprocket wheel 23. This second sprocket wheel 23 interacts with a third sprocket wheel 24 to drive the hub 4.

The rotatable part 3 includes a part adjacent to the stationary part 2 that is arranged with a first bearing ring 21 and mounted in the rotatable part 3. Threads are provided on the part of the rotatable part 3 which is adjacent to the stationary part 2. The threads are internally arranged in the part of the rotatable part 3. The bearing ring 21 is provided with external threads. The bearing ring 21 is configured to be connected with its threads to the threads arranged in the part of the rotatable part 3 which is adjacent to the stationary part 2. The bearing ring 21 is configured so that when it is mounted in the rotatable part 3 it is statically connected to the rotatable part 3. The bearing 20 is arranged between the first bearing ring 21 and an outer plate 19 of the turbine flow passage 17.

The turbine flow passage 17 is connected to the stationary part 2 with a first locking ring 18. The locking ring 18 is arranged on the inside of the turbine flow passage 17. A number of recesses 26 is arranged through the wall section 25 of the turbine flow passage 17. The recesses 26 go through the wall section 25 of the turbine flow passage 17. An attachment element 18 is arranged in each recess 26 of the turbine flow passage 17. The attachment element 27 has a length whereby when it is arranged in and through the recess 26 and through the wall section 25, part of it protrudes to the outside of the turbine flow passage 17. On the inside of the turbine flow passage 17 the attachment element 27 is designed with a head that has a diameter larger than the recess 26. The attachment element 27 can thereby not slide through the recess 26 since its head prevents this. The locking ring 18 in turbine flow passage 17 presses against the respective heads of the respective attachment elements 27 on the inside of the turbine passage flow 17. Due to this each attachment element is thereby held in place in each recess by means of resilient force from the locking ring 18. Each attachment element 27 extending to the outside of the turbine flow passage 17 fits into an inner edge section 28 arranged in the stationary part 2. When fitted into the inner edge section 28 of the attachment element 27 the turbine flow passage 17 thereby becomes connected to the stationary part 2.

Figure 2:
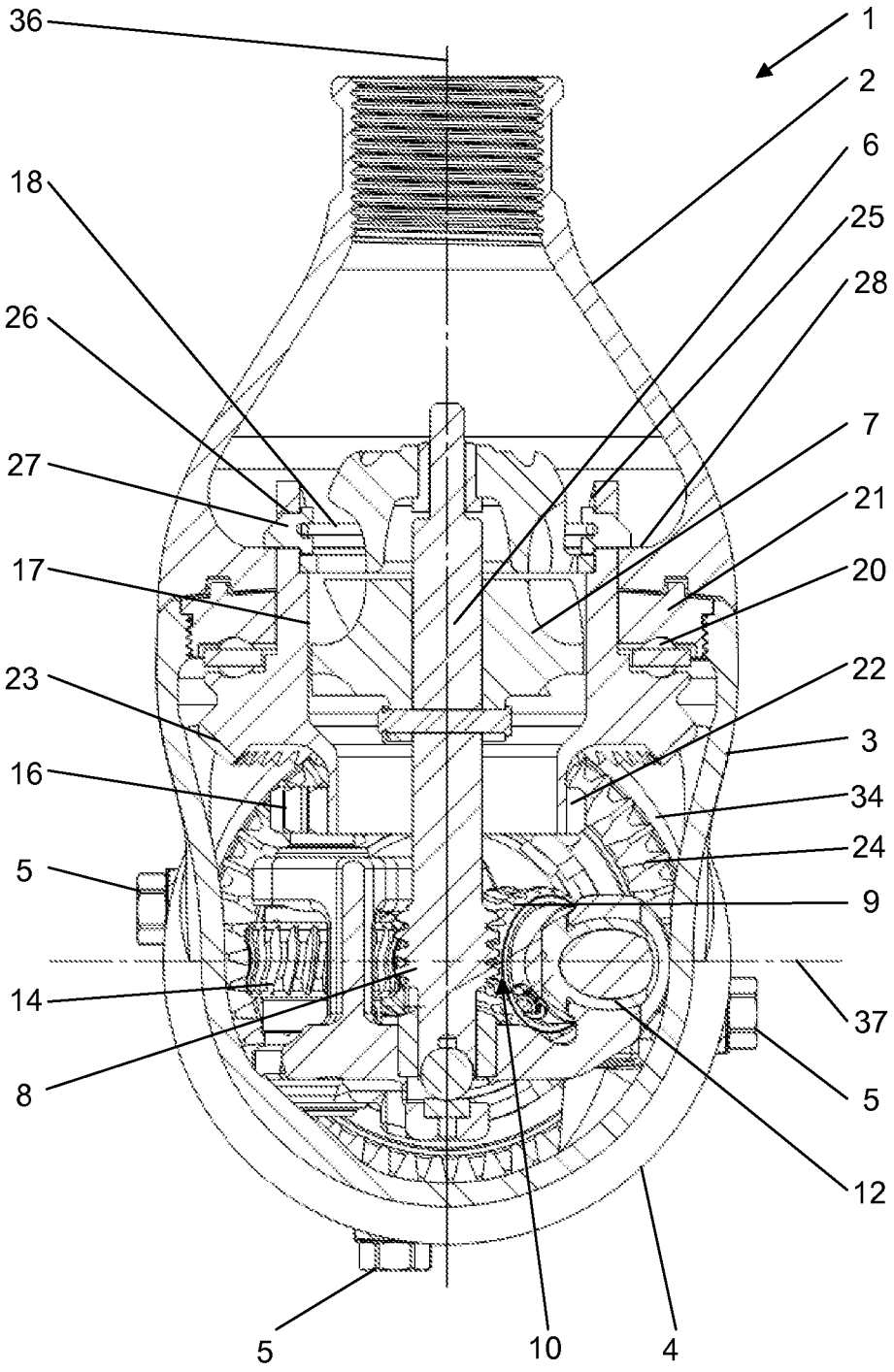
FIG. 2 shows a device according to the invention in cross-section from the rear.
Figure 3:
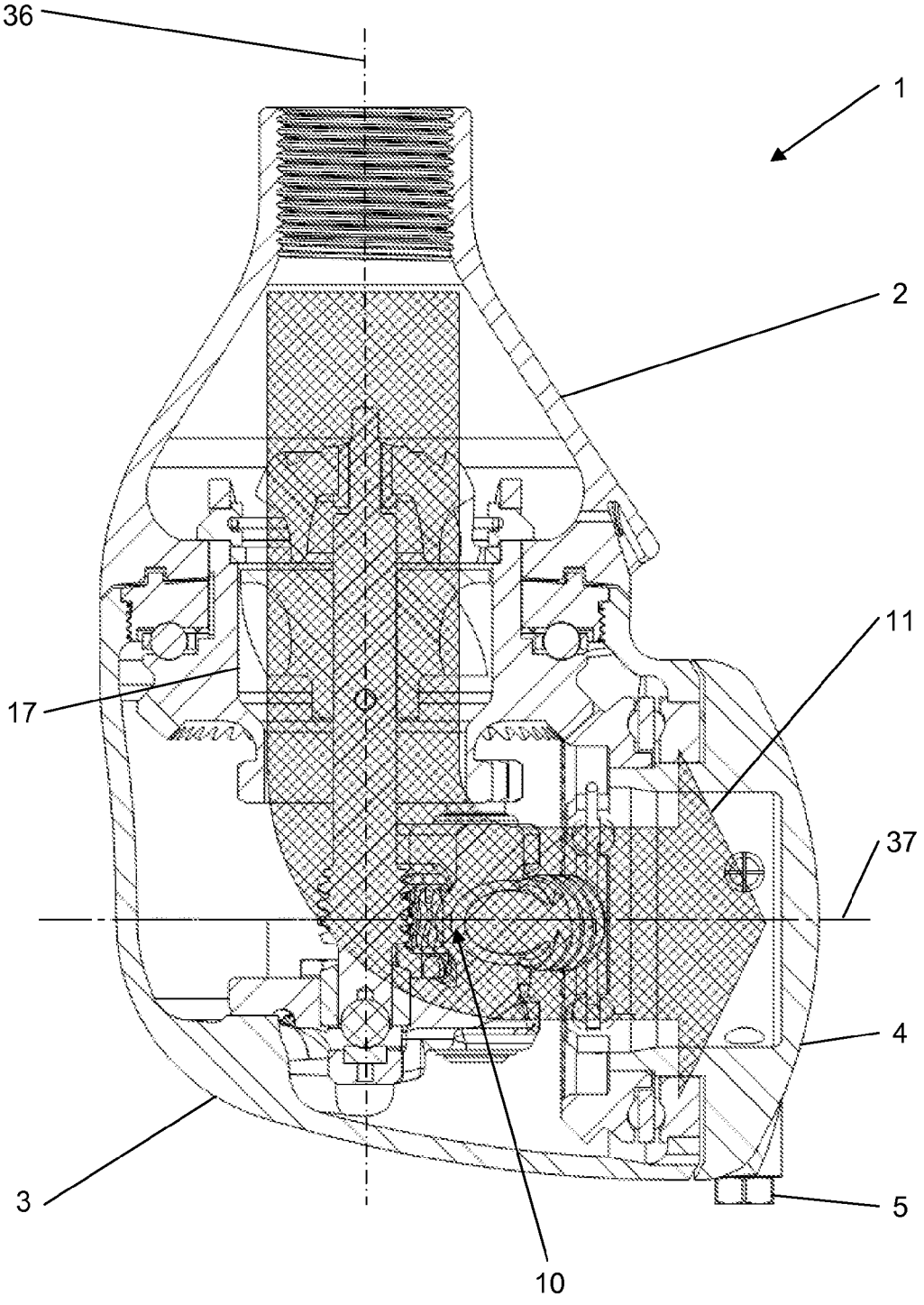
FIG. 3 shows a device according to the invention in cross-section from the side with the main flow path through the device.

FIG. 3 shows the device according to FIGS. 1 and 2 with a flow path 11 for liquid through the device. The flow path 11 for liquid through the device and the housing extends from and through the stationary part 2, through the turbine flow passage 17, into and through the rotatable part 3, the hub 4 and then out through the spraying nozzles 5. The gear unit is so arranged in the rotatable part 3 that the bulk of the liquid flow is passed through the worm gear towards spraying nozzles 5. This means that there is no so-called leakage flow which passes through the gear unit.

The hub 4 is arranged with the rotatable part 2. A second bearing ring 29 is arranged between the hub 4 and the rotatable part 3. This second ring bearing 29 is arranged in the rotatable part 3 in the same way as the first said bearing ring 21. The hub 4 extends with a tubular part 30 into the rotatable part 3 in the direction of the flow path 11. The hub's 4 tubular part 30 with a part located inside the rotatable part 3 is provided with recesses (not shown in the figure) in its wall, denoted hub wall 31. Second attachment elements 32 are arranged through these recesses. These other fastening elements 32 are arranged with a head with the part that is positioned on the inside of the tubular part 30. The attachment elements 32 are resiliently held in position by a second locking ring 33 which bears on the respective head for the second attachment element 32. The other fastening elements 32 extend through the respective recesses in the hub wall 31 extending to the outside of the tubular part 30. The tubular part 30 is arranged through a gear ring 34 with an externally arranged third sprocket wheel 24. The gear ring 34 is arranged on its inside with a groove 35, in which groove 35 the second attachment element 32 is arranged with its outermost part against this head. In this way the hub 4 is connected with and to the rotatable part 3.

During the operation of the device liquid is passed through a liquid inlet arranged in the stationary part 2. From the stationary part 2 the liquid is passed through the turbine flow passage 17 and on to the rotatable part 3. A rotation generating element 7, a so-called turbine, is arranged in the turbine flow passage 17. The turbine 7 and the first axis 6 are brought to rotate by the liquid flow through the device. The axis 6 is at one end provided with a first worm screw 8 which interacts with a first gear wheel 9 and which first gear wheel 9 is brought to rotate by the first worm screw 8. The first gear wheel 9 is arranged on a second axis 12 that is provided with a second worm screw 13. Rotational movement of the first gear wheel 9 is transmitted via the second axis 12 to the second worm screw 13. Said second worm screw 13 interacts with a second gear wheel 14 arranged on a third axis 15. This third axis 15 is brought to rotate and transmit its rotation via a third gear wheel 16 arranged on the third axis 15 to a first sprocket wheel 22 arranged in the turbine flow passage 17.

The turbine flow passage 17 has a static position relative to the stationary part 2. When the third gear wheel 16 is driven against the first sprocket wheel 22 the rotatable part 3 is brought to rotate about a first center axis 36 that extends centrally through the first axis 6. A second sprocket wheel 23 is also arranged on the outside of the turbine flow passage 17. The second sprocket wheel 23 interacts with a third sprocket wheel 24 connected to the hub 4. On rotation of the rotatable part 3 around said first center axis 36, the third sprocket wheel 24 with the hub 4 is brought to rotate around a second center axis 37 extending centrally through the second sprocket wheel 23 and the hub's 4 tubular part 30. The liquid is thereby brought to be sprayed from the spraying nozzles 5 arranged on the hub 4 both in a way in which the rotatable part 3 and the hub 4 with the spraying nozzles 5 rotate around the first center axis 36, and in a way in which the hub 4 and spraying nozzles 5 in relation to the rotatable part 3 rotate around the second center axis 37. In this way the device with the liquid is brought to clean all surfaces in a closed space. The extensions of the first and second centre axes (36, 37) intersect at a point inside the rotatable part 3. The first and second centre axes' (36, 37) extensions essentially form a right angle.

The invention is not limited to the showed embodiment but can be varied and modified within the scope of the following claims, which in part has been described above.

REFERENCE SIGNS housing 1
stationary part 2
rotatable part 3
hub 4
spray nozzle 5
axis 6
rotation generating element 7
worm screw 8
first gear wheel 9
worm gear 10
flow path 11
second axis 12
second worm screw 13
second gear wheel 14
third axis 15
third gear wheel 16
turbine flow passage 17
locking ring 18
outer plate 19
bearing 20
first bearing ring 21
first sprocket wheel 22
second sprocket wheel 23
third sprocket wheel 24
wall section 25
recess (turbine flow passage) 26
attachment elements 27
inner edge section 28
second bearing ring 29
tubular part 30
hub wall 31
second attachment element 32
second locking ring 33
gear ring 34
groove 35
first center axis 36
second center axis 37

The invention claimed is:

1. Device for cleaning of closed spaces using a sprayed liquid, including a housing (1) with a stationary part (2) configured to receive liquid into the device and a rotatable part (3) arranged with the stationary part (2), whereby the rotatable part (3) is rotatably arranged with a hub (4) with at least one spray nozzle (5), whereby in the housing (1) a first part of an axis (6) is connected to a rotation generating element (7) in the housing (1) and a second part is provided with threads forming a worm screw (8), which worm screw (8) is arranged to fit into the threads of an adjacent first gear wheel (9) forming a worm gear (10), which worm gear (10) is configured to transmit rotational force from the rotation generating element (7) via the axis (6) for rotating the hub (4) and the rotatable part (3), whereby the rotation generating element (7), the axis (6) and the worm gear (10) are arranged in a flow path (11) for liquid flowing through the device (11), whereby the bulk of liquid flows through the worm gear (10) in a direction towards at least one spray nozzle (5).

2. Device according to claim 1, wherein the first gear wheel (9) is arranged on a second axis (12).

3. Device according to claim 2, wherein the second axis (12) has a part provided with threads forming a second worm screw (13).

4. Device according to claim 3, wherein the threads of the second worm screw (13) fit into the threads to a second gearwheel (14).

5. Device according to claim 4, wherein the second gearwheel (14) is arranged on a third axis (15).

6. Device according to claim 5, wherein the third axis (15) is provided with a third gear (16).

7. Device according to claim 5, wherein the third axis (15) is parallel to the first axis (6).

8. Device according to claim 2, wherein the second axis (12) is perpendicularly arranged with respect to at least one of the first (6) or a third axis (15).

9. Device according to claim 1, wherein a turbine flow passage (17) is arranged between the stationary part (2) and the rotatable part (3).

10. Device according to claim 9, wherein the turbine flow passage (17) is connected to the stationary part (2) with a locking ring (18).

11. Device according to claim 8, wherein a turbine flow passage (17) is provided with an outer plate (19).

12. Device according to claim 11, wherein the outer plate (19) is configured to bear on a bearing (20).

13. Device according to claim 12, wherein the bearing (20) is arranged against a bearing ring (21).

14. Device according to claim 13, wherein the bearing ring (21) is connected to the rotatable part (3).

15. Device according to claim 1, wherein the rotation generating element (7) is mainly arranged in the stationary part (2).

16. Device according to claim 1, wherein the rotation generating element (7) is a turbine.

* * * * *